US007975395B2

(12) United States Patent
Keller et al.

(10) Patent No.: US 7,975,395 B2
(45) Date of Patent: Jul. 12, 2011

(54) HAND-HELD LEVEL AND PLUMB TOOL

(75) Inventors: Stephannie Keller, Edina, MN (US); Judith A. Beard, Apple Valley, MN (US); Lori A. Ebner, Oakdale, MN (US); Peter S. Keller, Edina, MN (US); Lawrence J. Paul, Knapp, WI (US)

(73) Assignee: SLK Development Group, LLC, Edina, MN (US)

( * ) Notice: Subject to any disclaimer, the term of this patent is extended or adjusted under 35 U.S.C. 154(b) by 233 days.

(21) Appl. No.: 12/208,123

(22) Filed: Sep. 10, 2008

(65) Prior Publication Data

US 2009/0013546 A1 Jan. 15, 2009

Related U.S. Application Data

(63) Continuation-in-part of application No. 11/013,569, filed on Dec. 15, 2004, now abandoned.

(51) Int. Cl.
*B43L 7/027* (2006.01)

(52) U.S. Cl. ..... 33/451; 33/474

(58) Field of Classification Search ..... 33/451, 33/474, 476, 479, 480, 377
See application file for complete search history.

(56) References Cited

U.S. PATENT DOCUMENTS

| | | | | |
|---|---|---|---|---|
| 583,058 | A | | 5/1897 | King |
| 817,515 | A | | 4/1906 | Polimeni |
| 1,022,396 | A | | 4/1912 | Allen |
| 1,298,010 | A | | 3/1919 | Coleman |
| 2,570,430 | A | | 10/1951 | Cramer |
| 3,303,569 | A | | 2/1967 | Wyatt |
| 4,964,219 | A | | 10/1990 | Clark |
| 5,170,505 | A | | 12/1992 | Rohrer |
| 5,269,066 | A | | 12/1993 | Walters |
| 5,452,522 | A | * | 9/1995 | Kook et al. ..... 33/451 |
| 5,456,015 | A | | 10/1995 | Butcher et al. |
| 5,524,353 | A | | 6/1996 | Fink |
| 5,720,114 | A | | 2/1998 | Guerin |
| 5,749,154 | A | * | 5/1998 | Scharf ..... 33/563 |
| 5,884,408 | A | | 3/1999 | Simmons |
| 5,933,974 | A | | 8/1999 | Walters et al. |
| 6,122,834 | A | | 9/2000 | Rester |
| 6,272,758 | B1 | | 8/2001 | Wheeler |
| 6,415,520 | B1 | | 7/2002 | Locklear |
| 6,807,743 | B2 | | 10/2004 | Odachowski |
| 6,807,777 | B2 | | 10/2004 | Wagner et al. |
| D500,691 | S | | 1/2005 | Fesmire |
| 6,996,911 | B1 | | 2/2006 | Dinius |
| 7,171,755 | B1 | | 2/2007 | Arent et al. |
| 7,243,436 | B2 | | 7/2007 | Casner et al. |

(Continued)

*Primary Examiner* — Yaritza Guadalupe-McCall
(74) *Attorney, Agent, or Firm* — Dicke, Billig & Czaja, PLLC

(57) ABSTRACT

A hand-held level and plumb tool that includes a homogeneous, L-shaped body, a first level indicating device, and a second level indicating device. The L-shaped body has first and second legs arranged at a 90° angle. The first leg defines an interior side, an exterior side, a central panel extending between the sides, and a length in extension of the first leg from the second leg to a free end. A slot is formed through a thickness of the central panel and extends along at least a majority of the length. The first level indicating device is assembled to the central panel of the first leg at a location spaced from the slot. The second level indicating device is assembled to the second leg. One or both of the legs can include measurement-related indicia selected in accordance with staircase construction standard dimensions.

18 Claims, 6 Drawing Sheets

U.S. PATENT DOCUMENTS

| | | | |
|---|---|---|---|
| 7,363,719 | B2 | 4/2008 | Levinson et al. |
| 2005/0022397 | A1 | 2/2005 | Neblo |
| 2006/0123646 | A1 | 6/2006 | McRae |
| 2006/0277776 | A1 | 12/2006 | Paul |

* cited by examiner

HAND-HELD LEVEL AND PLUMB TOOL

CROSS-REFERENCE TO RELATED APPLICATIONS

This application is a continuation-in-part of U.S. application Ser. No. 11/013,569, filed Dec. 15, 2004 now abandoned and entitled "Multipurpose Construction Gauge," the teachings of which are incorporated herein by reference.

BACKGROUND

The success of many different construction projects is premised upon the ability of the carpenter or builder to determine whether a particular structural member forms a 90° angle and/or to craft such a structure. A carpenter's square is a well-known tool used to provide this information, having the basic form of an L-shaped body with legs extending at a 90° angle relative to one another. The carpenter's square is commonly used for various projects including home remodeling, masonry, window/door installation, picture hanging, and staircase construction, to name but a few.

While the carpenter's square is universally accepted, several construction-related needs remain unresolved. For example, most carpenter's squares do not provide plumb and/or level indications, such that a separate level-type tool is required. While several carpenter's square-type tools have been suggested in which a level bubble device is mounted to one of the carpenter's square legs, the available tools are less than optimal in terms of, for example, locating the level bubble device(s) at a position that facilitates ease of use for various, common applications. Similarly, carpenters and others commonly desire to make measures, oftentimes requiring a separate tool in addition to the standard carpenter's square. Even further, conventional carpenter's squares are not optimally configured for certain end-uses, such as staircase construction/evaluation, etc. Therefore, a need exists for a combination level and plumb tool that facilitates convenient use for a wide variety of applications.

SUMMARY

Aspects in accordance with principles of the present disclosure relate to a hand-held level and plumb tool. The tool includes a homogeneous, L-shaped body, a first level indicating device, and a second level indicating device. The L-shaped body includes first and second legs arranged relative to one another to define a 90° angle. Further, the first leg defines an interior side, an exterior side, a central panel extending between the sides, and a length in extension of the first leg from the second leg to a free end. A slot is formed through a thickness of the central panel and extends along at least a majority of the length. With this in mind, the first level indicating device is assembled to the central panel of the first leg at a location spaced from the slot. The second level indicating device is assembled to the second leg. With this construction, the level indicating devices provide a user with a simultaneous indication of level and plumb, with the slot providing a convenient area for marking of a structure using a pencil or other implement. In some embodiments, the second leg has a construction similar to that of the first leg, and includes a slot extending along the second leg and open to the slot of the first slot. In related embodiments, the second level indicating device is assembled to the second leg member apart from the corresponding slot; with these constructions, the level indicating devices do not interfere with a user's ability to mark a structure through either of the slots. In yet other embodiments, one or both of the legs include measurement-related indicia selected in accordance with standard staircase construction dimensions.

DETAILED DESCRIPTION

Figure 1:
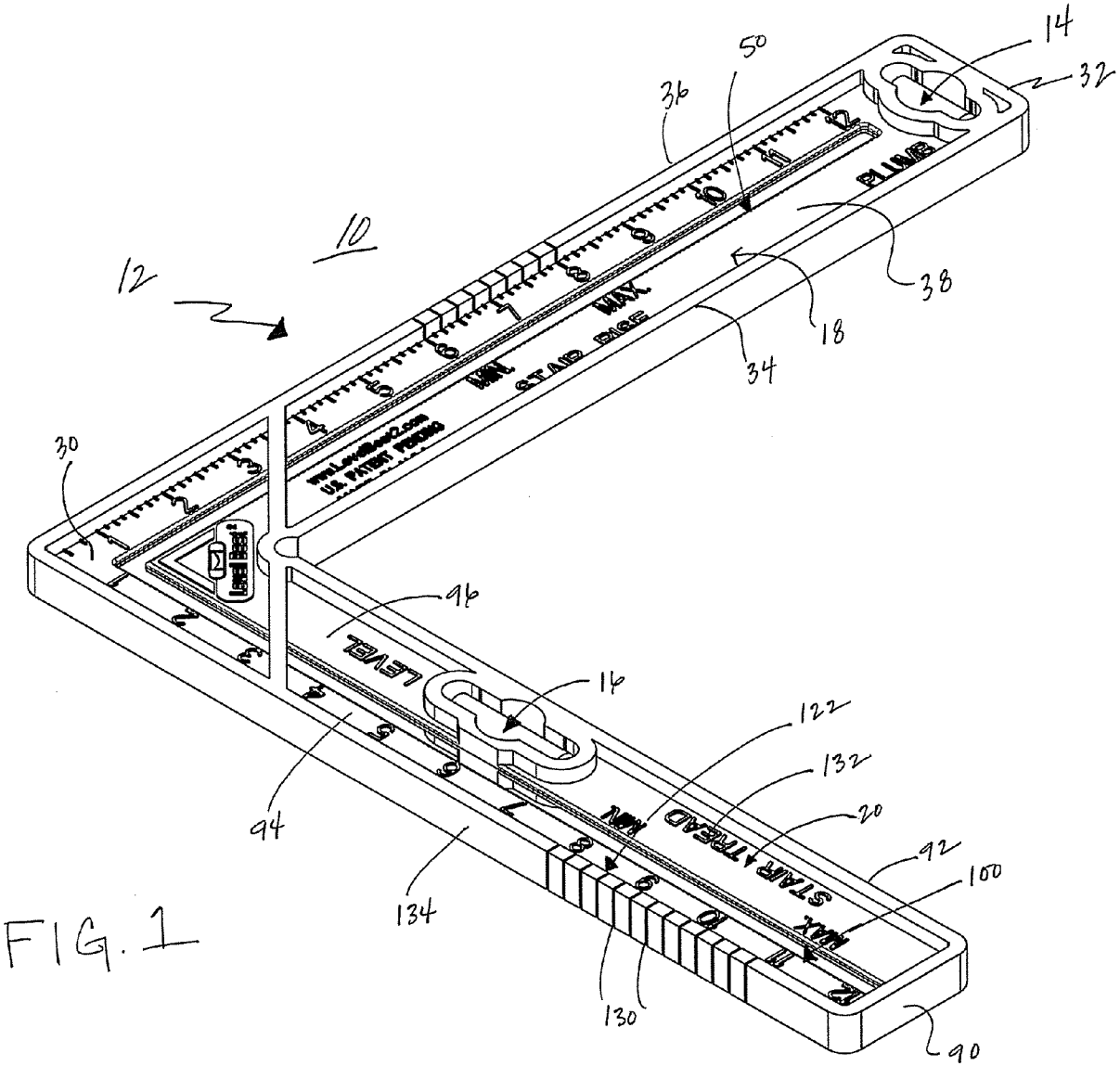
FIG. 1 is a perspective view of a tool in accordance with principles of the present disclosure.

A hand-held level and plumb tool 10 in accordance with the present disclosure is shown in FIG. 1. The tool 10 includes an L-shaped body 12, a first level indicating device 14, and a second level indicating device 16. Details on the various components are provided below. In general terms, however, the L-shaped body 12 includes first and second legs 18, 20 arranged at a 90° angle relative to one another. The first level indicating device 14 is assembled to the first leg 18, whereas the second level indicating device 14 is assembled to the second leg 20. With this construction, the tool 10 can assist a user in performing various projects in which right angle, level, and/or plumb information is desired. Additional features described below optimize usefulness of the tool 10 in performing various activities.

The L-shaped body 12 has an integral, homogeneous construction in some embodiments, establishing a rigid connection between the legs 18, 20 so as to ensure maintenance of the 90° relationship described above. For example, the L-shaped body 12 can be formed as an injection molded plastic body. The legs 18, 20 can have differing or identical lengths as described below, for example in the range of 4-24 inches. In some embodiments, the L-shaped body has dimensions of 13.5"×12.5", alternatively 16"×24", alternatively 6.5"×7.5", although other dimensions are also contemplated.

Figure 2:
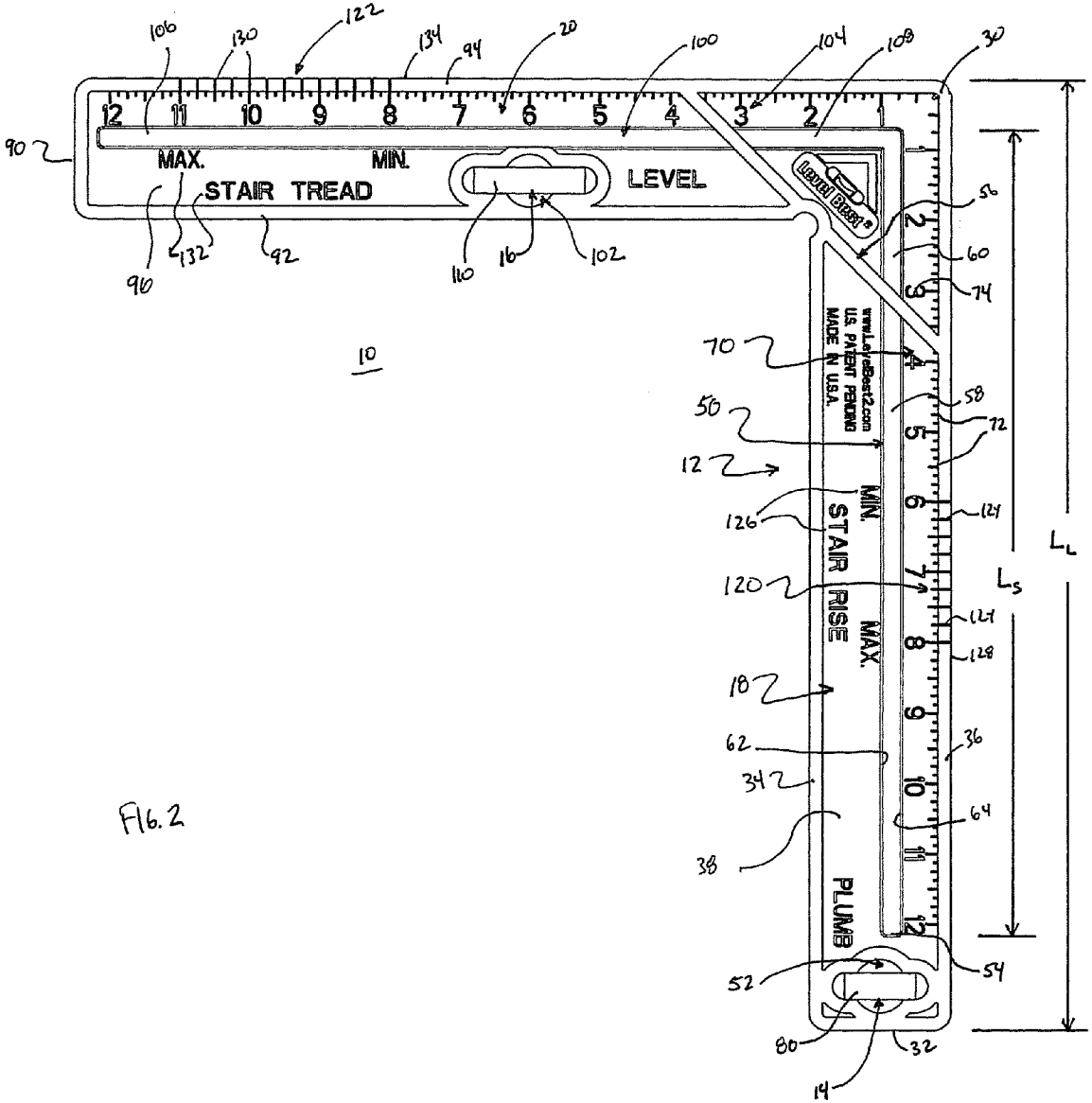
FIG. 2 is a top view of the tool of FIG. 1.

Regardless of the materials and/or manufacturing techniques utilized in forming the L-shaped body 12, the first leg 18 extends from an intersection 30 (referenced generally) with the second leg 20 to a free end 32. More particularly, the first leg 18 defines an interior side 34, and exterior side 36, and a central panel 38 as shown in FIG. 2. With additional reference to FIG. 3A, the sides 34, 36 and the central panel 38 combine to define opposing major faces 40, 42 of the first leg 18. As reflected in FIG. 3A, in some embodiments, the interior and exterior sides 34, 36 are defined by a frame 44 having a thickness $T_F$ that is greater than a thickness $T_P$ of the central panel 38, and the central panel 38 is centered relative to the thickness $T_F$ of the frame 44. Regardless, by offsetting the central panel 38 from the frame 44 along the major faces 40, 42, a stable support plane is established for consistent placement against a flat surface during use. That is to say, regardless of variations in thickness or planarity of the central panel 38, the enlarged thickness sides 34, 36 better ensure that the first leg 18 can be consistently lodged against a flat surface. Alternatively, an entirety of the first leg 18 can be planar.

Figure 3B:
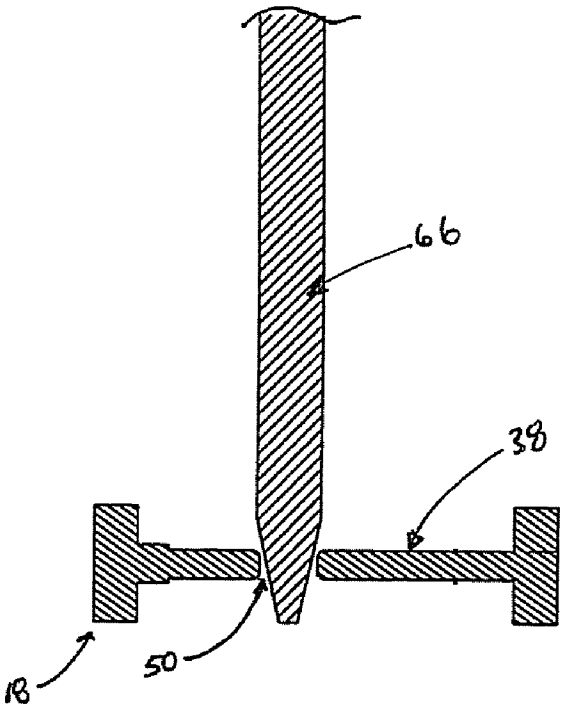
FIG. 3B illustrates the tool portion of FIG. 3A in combination with a writing implement.
Figure 3A:
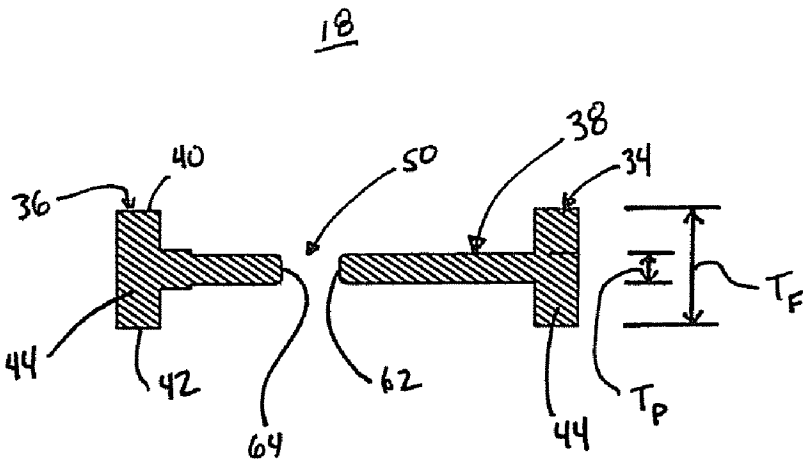
FIG. 3A is a cross-sectional view of a portion of the tool of FIG. 1.
Figure 4:
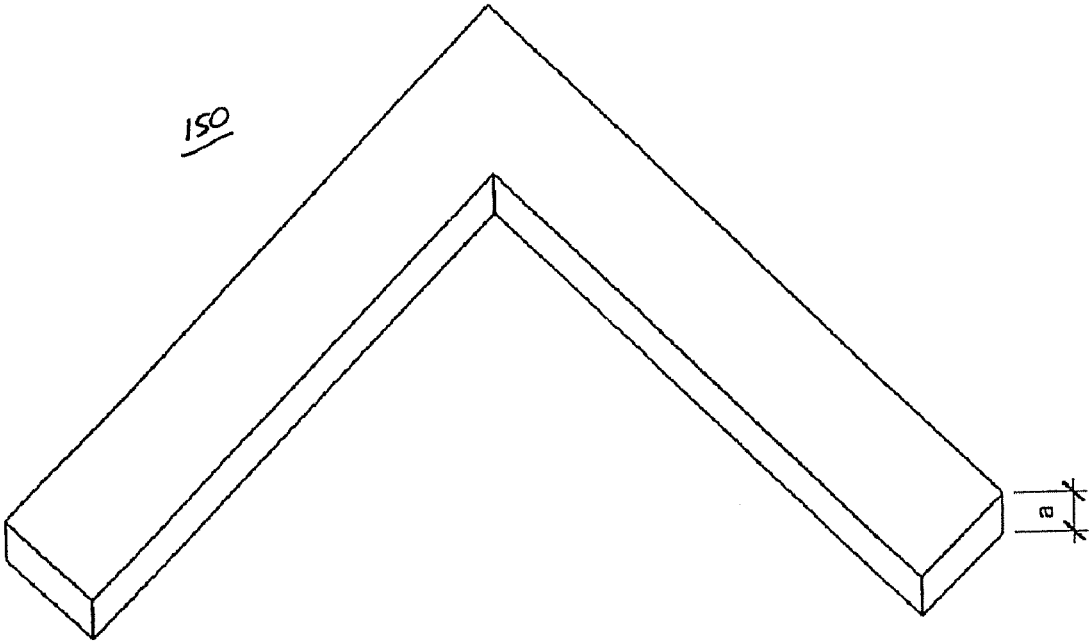
FIGS. 4-8 are perspective views of alternative tools in accordance with principles of the present disclosure.
Figure 5:
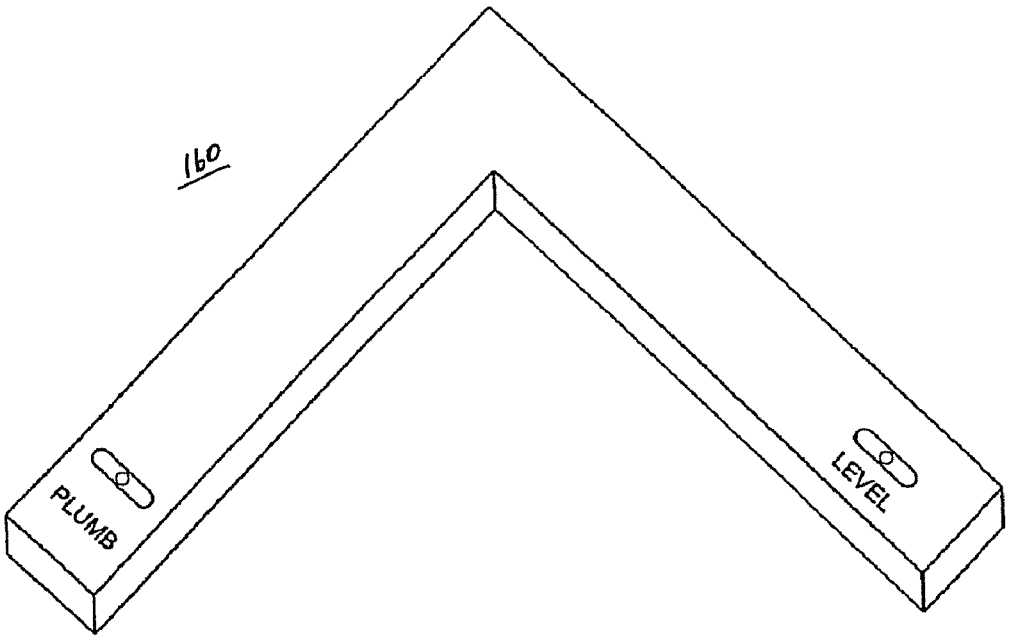
Figure 6:
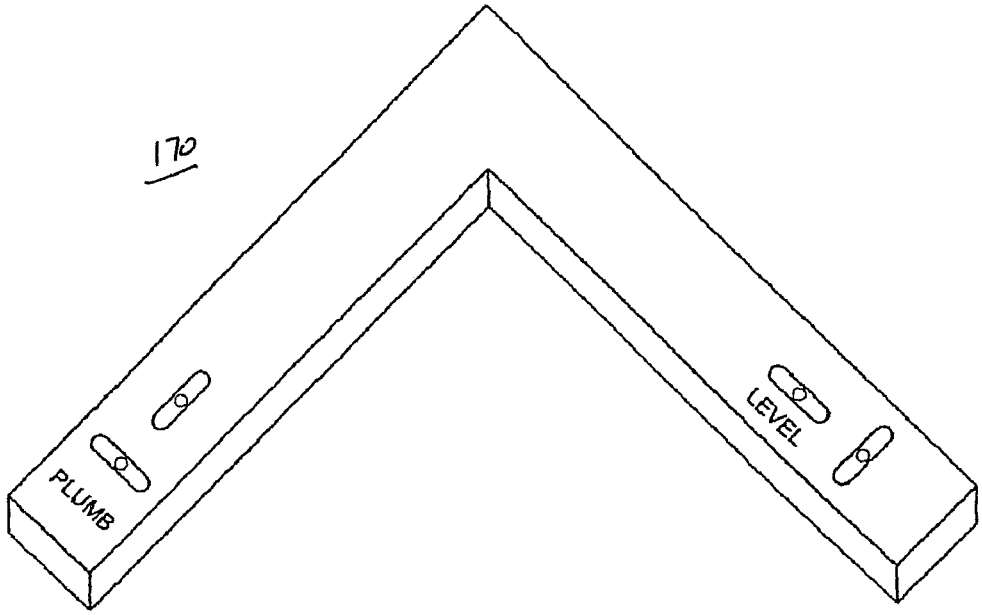
Figure 7:
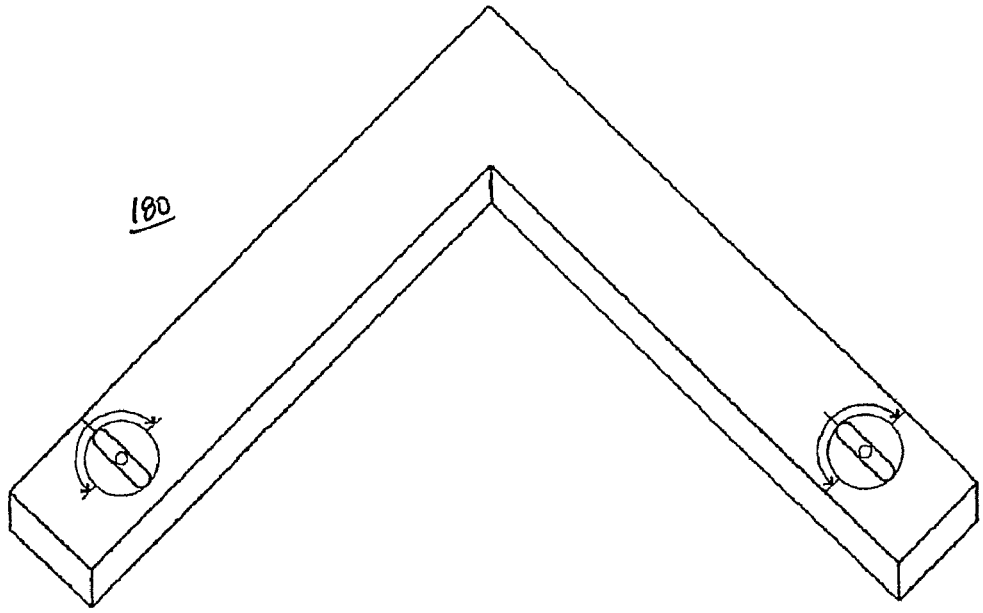
Figure 8:
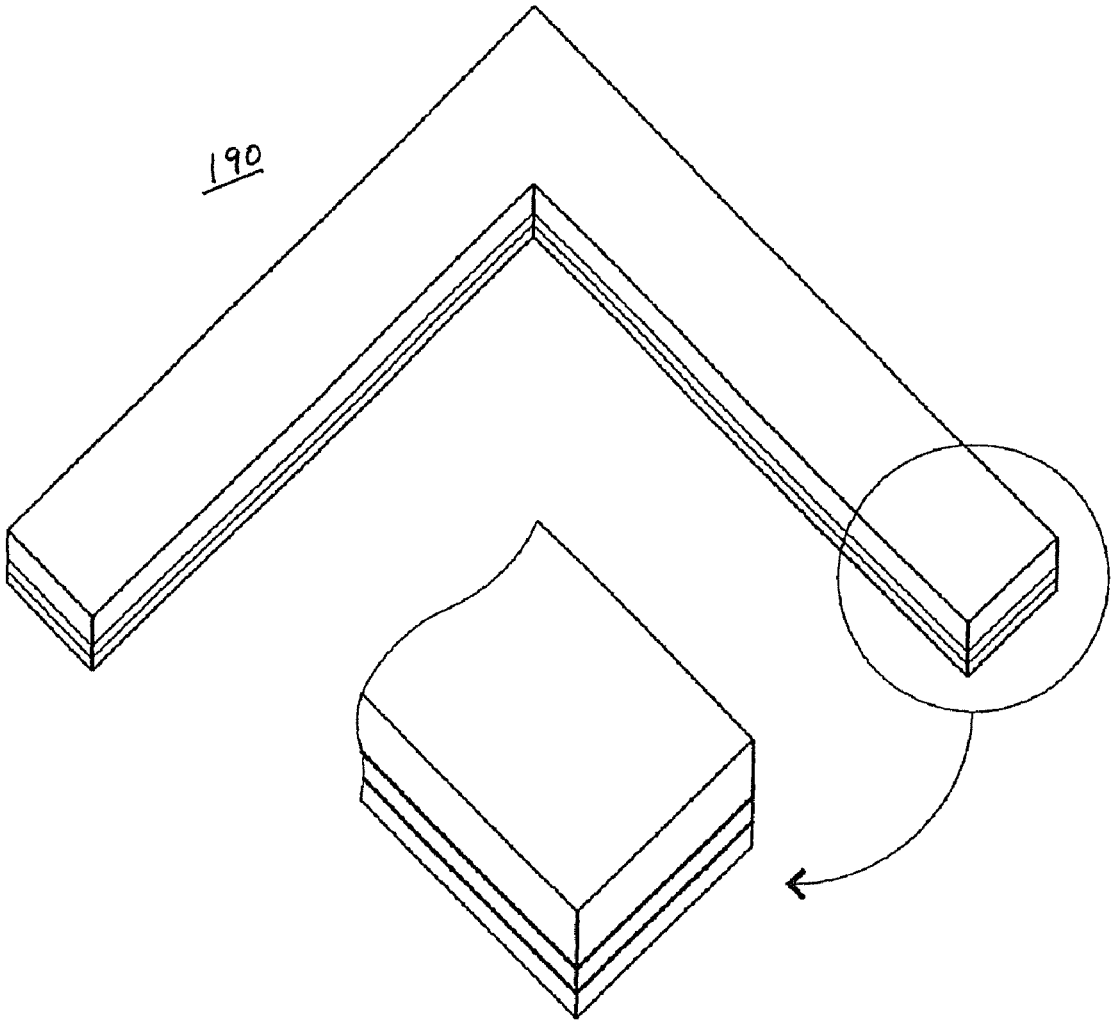

Returning to FIG. 2, the frame 44 as described above can extend to and along the free end 32. Regardless, the first leg 18 forms a slot 50 and a mounting aperture 52. The slot 50 extends from the intersection 30, and terminates at a slot end 54 adjacent the free end 32. In some embodiments, the L-shaped body 12 can include or form a support rib 56 for enhanced rigidity and that passes through the slot 50, thus dividing the slot 50 into two (or more) slot segments 58, 60. The slot 50 extends through the thickness $T_P$ of the central panel 38 as shown in FIG. 3A, defining a width sized to receive and allow passage of a writing implement, such as a carpenter's pencil 66 as reflected in FIG. 3B. For example, the slot 50 can have a width on the order of 0.25 inch in some embodiments. Regardless, and as shown in FIGS. 2 and 3A, the slot 50 is defined by opposing, linear edges 62, 64 that provide a convenient surface for guiding the writing implement 66 in generating a straight line as the writing implement 66 is moved along/guided by the slot 50.

With specific reference to FIG. 2, the slot 50 extends at least a majority of a length of the first leg 18. More particularly, the first leg 18 defines a length $L_L$ in extension from the intersection 30 to the free end 32. Similarly, the slot 50 defines a slot length $L_S$ in extension to the slot end 54. With these designations in mind, the slot length $L_S$ is at least 50% of the leg length $L_L$; alternatively, at least 75%; and in other embodiments, at least 80%. Regardless, a significant area is provided by the slot 50 for facilitating formation of a relatively long line on a surface to which the tool 10 is placed via the writing implement 66 (FIG. 3B) as described above.

In addition to facilitating formation of a line, the elongated slot 50 permits marking of a surface at a desired measurement or dimension. For example, the slot 50 is located adjacent the exterior side 36 (i.e., the slot 50 is closer to the exterior side 36 as compared to the interior side 34), with the first leg 18 further including measurement indicia 70. The measurement indicia 70 reflects precise distances along the exterior side 36 relative to the intersection 30. Thus, the measurement indicia 70 can assume a variety of forms, including markings 72 spaced at conventional distances (e.g., inch markings, half-inch markings, quarter-inch markings, etc.; or metric-related markings), along with corresponding numeric designators 74. As shown, the slot 50 is formed in close proximity to the measurement indicia 70, such that a relatively precise measurement mark can be made by a writing implement (e.g., the writing implement 66 of FIG. 3B) passing through the slot 50 at the marking 72 desired by the user (e.g., a user wishing to mark a surface at a distance of 5 inches from the intersection 30 can pass a writing implement through the slot 50 at a point immediately adjacent the marking 72 corresponding with the numeric designator 74 indicating a 5 inch distance). Alternatively, the user can form a measurement marking adjacent at the exterior side 36 and/or the interior side 34. The measurement indicia 70 can reflect a variety of lengths, and in some embodiments includes a maximum distance of 12 inches.

The mounting aperture 52 is configured to receive and maintain the first level indicating device 14, and thus can assume a variety of forms. For example, where the first level indicating device 14 is a bubble-type level indicator, the mounting aperture 52 is sized to frictionally receive and maintain a vial 80 component thereof. Regardless, the mounting aperture 52 is located apart from the slot 50 such that the first level indicating device 12 does not obstruct or otherwise impede use of the slot 50 in forming a desired measurement marking. In some embodiments, the mounting aperture 52, and thus the first level indicating device 14, is located between the free end 32 and the slot end 54. With this location, during use of the tool 10 in which the L-shaped body 12 is arranged in the orientation reflected in FIG. 2 (e.g., the second leg 20 is placed on top of an elevated surface such as a door or picture, and the first leg 18 extends vertically downwardly from this structure), the first level indicating device 14 will be located in closer proximity to a user's line of sight. Thus, when using the tool 10 along a surface that is above the user's head, the first level indicating device 14 will be conveniently located in closer proximity to the user's line of sight. Alternatively, the mounting aperture 52, and thus the first level indicating device 14, can be located at other positions along the first leg 18.

In some embodiments, the second leg 20 is highly similar to the first leg 18, and defines a free end 90 opposite the intersection 30 with the first leg 18. Further, the second leg 20 includes an interior side 92, an exterior side 94, and a central panel 96. The sides 92, 94 and the central panel 96 can have the constructions described above with respect to the sides 34, 36 and the central panel 38 of the first leg 18, with the sides 92, 94 of the second leg 20 having an increased thickness as compared to the central panel 96 as previously described. The second leg 20 can further form a slot 100 and a mounting aperture 102. The slot 100 extends along at least a majority of a length of the second leg 20, and is located proximate measurement indicia 104 formed on the second leg 20 adjacent the exterior side 94. As shown, the optional support rib 56 can pass through the slot 100, thereby dividing the slot 100 into slot segments 106, 108. The slots 50, 100 are, in some constructions, open to one another at the intersection 30 (e.g., the slot segment 60 is open or contiguous with the slot segment 108), thereby facilitating formation of a right angle-type line via a writing implement passed along the slot segments 60, 108. In other embodiments, one or both of the slots 50 and/or 100 can be eliminated.

The mounting aperture 102 is sized and shaped to receive and maintain the second level indicating device 20. For example, where the second level indicating device 20 is a bubble-type level, the mounting aperture 102 is sized and shaped to frictionally maintain a vial 110 provided with the second level indicating device 16. With embodiments in which the second leg 20 includes the slot 100, the mounting aperture 102, and thus the second level indicating device 16, is located apart from the slot 100 so as to maximize an available area of the slot 100. For example, the mounting aperture 102, and thus the second level indicating device 16, can be located between the slot 100 and the interior side 92. As compared to a location of the first level indicating device 14 relative to the first leg 18, a location of the second level indicating device 16 along the second leg 20 provides for an enlarged surface area, such that the second level indicating device 16 can be larger than the first level indicating device 14. Along these same lines, by locating the second level indicating device 16 away from the free end 90, an overall length of the second leg 20 can be less than the length $L_L$ of the first leg 18. In other words, while the measurement indicia 70 of the first leg 18 and the measurement indicia 104 of the second leg 20 can be identical (or otherwise provide an identical maximum distance relative to the intersection 30), the first leg 18 can be longer than the second leg 20 to accommodate desired positioning of the first level indicating device 14. Alternatively, however, the mounting aperture 102, and thus the second level indicating device 16, can be located at any other point along the second leg 20.

In some embodiments, the first and second level indicating devices 14, 16 are arranged in a similar, level-indicating direction. For example, in some embodiments, the first and second level indicating devices 14, 16 are bubble-type levels as known in the art, and extend horizontally as shown in FIG. 2. Alternatively, one of the level bubbles 14 or 16 can be arranged perpendicular relative to the other bubble level 14 or 16. Regardless, the legs 18, 20 can include directional indicia 112, 114, respectively, that indicates to a user a context of the level indicating device 14 or 16 relative to extension of the corresponding leg 18 or 20. For example, the directional indicia 112 of the first leg 18 can indicate a "plumb" direction, whereas the directional indicia 114 of the second arm 20 can indicate a "level" direction. Alternatively, the indicia 112 and/or 114 can be omitted.

In addition to the measurement indicia 70, 104, in some embodiments, the first and second legs 18, 20 provide secondary indicia, such as staircase indicia 120, 122, respectively. In general terms, the staircase indicia 120, 122 relates to standard dimensional ranges dictated by staircase construction regulations. More particularly, governmental organization(s) regulating building construction commonly promulgate rules or standards regarding the minimum and maximum vertical distance between adjacent steps of a staircase (stair rise), as well as minimum and maximum horizontal dimensions of individual steps (stair run or tread). With this in mind, the staircase indicia 120, 122 readily informs a user of the tool 10 of these parameters. For example, the first staircase indicia 120 can include markings 124 and optionally, one or more words 126. The markings 124 are formed along the exterior side 34 of the first leg 18, and corresponding with the numeric designators 74 of the measurement indicia 70 relative to minimum and maximum stair rise parameters. For example, in some locales, an acceptable stair rise is in the range of 6-8 inches. Thus, the markings 124 of the first staircase indicia 120 are formed along the exterior side 36 only at distances in the range of 6-8 inches (as reflected by the measurement indicia 70). In some embodiments, the markings 124 can further extend along an exterior face 128 of the first leg 18 (referenced generally in FIG. 2 and described in greater detail with respect to the second leg 20 as shown in FIG. 1). To enhance a user's ability to correlate the markings 124 with a staircase being constructed or evaluated, the markings 124 can be formed as grooves. The words 126 more clearly indicate to a user the implications of the markings 124, and can include words or abbreviations relating to or conveying minimum stair rise and/or maximum stair rise measurements.

The second staircase indicia 122 provided with the second leg 20 is similar in many respects. For example, the second staircase indicia 122 can include markings 130 and one or more words 132. The markings 130 are formed on the exterior side 94 at locations corresponding with acceptable stair run or tread parameters, and correlated with the measurement indicia 104. For example, the markings 130 of the second stair case indicia 122 are formed only at dimensions in the range of 8-11 inches. Further, the words 132 can inform a user as to the implications of the markings 130, such as minimum and/or maximum stair tread or run. Regardless, and as best shown in FIG. 1, the markings 130 can extend along an exterior face 134 of the second leg 20.

The tool 10 can incorporate additional, optional features in some embodiments. For example, a notch 140 can be formed at the intersection 30 of the interior sides 34, 92 of the first and second legs 18, 20, respectively. The notch 140 serves to eliminate formation of a tight or rigid corner at the interior sides 34, 92. Thus, where the tool 10 is placed onto a right-angled structure, a corner of the structure can be received within the notch 140, such that any deviations of the corner from a true right angle do not impede desired, flush engagement of the L-shaped body 12 against the structure.

The tool 10 is highly useful in performing a wide range of construction-related projects. For example, the tool 10 can be employed to make precise measurement-type markings relative to a right angle-type structure. Similarly, the tool 10 can be employed to precisely lay masonry for foundations (e.g., the second leg 20 placed on top of a concrete block or structure, with the first leg 18 extending downwardly along that structure). Similarly, the tool 10 can be employed to install windows or doors, ensure level and plumb on any installation (e.g., pictures), etc. In short, the tool 10 finds usefulness with any construction project in which a user desires knowledge of level, plumb, squareness, and/or dimensional measurements. Further, the tool 10 is useful with staircase construction, with the staircase indicia 120, 122 providing a rapid understanding as to whether a constructed staircase satisfies code requirements or regulations.

Other embodiments of tools in accordance with principles of the present disclosure are shown in FIGS. 4-8 as tools 150, 160, 170, 180, and 190.

These, and other similarly formed tools, facilitate various construction projects. For example, workmanlike installation of pre hung window requires that the unit be oriented so that the window heads and sills (frame top and bottom holding the window glass) are level and the jambs (vertical frame members holding the window glass) are plumb within its surrounding mounting opening. In addition, the inner sill must be positioned in such a manner that the sill's intrusion past the interior plane of the mounting opening is the same distance as the thickness of the drywall or wallboard which will later be attached to the wall(s) surrounding the installed window. Proper installation of framed doors requires essentially the same procedure.

In the United States, drywall or wallboard is currently manufactured in standard thicknesses of ⅜, ½ and ⅝ths of an inch respectively. Drywall or wallboard is also manufactured in metric thickness for example within the European Union.

The laying of masonry, whether in the form of cement blocks or bricks also requires constant verification of level, plumb and square as each block or brick is laid in rows or courses. The present disclosure allows the user to verify level plumb and proper gapping of the interior window sill in one operation using one device or gauge.

In some embodiments, the tools of the present disclosure ensure installation of pre hung windows and doors within their mounting frame openings in a plumb, square and level manner with the proper gapping of the sills and frames to permit sheet rock to be attached around the frame so that the edge of sheet rock will be flush with the face of the respective frame. The tools may also be used in masonry applications to continuously verify that bricks or cement blocks are level along the current course, plumb with the preceding course and flush with respect to each adjoining block or brick during their erection.

In some embodiments, the tool comprises a gauge in the form of a framing square comprising two legs with flat, parallel sides oriented at a 90° to each other. The thickness of the gauge is equal to the thickness of the sheet rock to be applied to the surfaces surrounding the window unit. Means for determining and indicating level or plumb are incorporated into each leg of the gauge. The means for indicating level or plumb may comprise a bubble, plumb line or gauge, protracting device indicating a discrete angle, laser or any other method of measuring and indicating a 90° or 180° angle in any plane. Alternatively, the means for indicating level and plumb may be embedded into both arms.

Optionally, the gauge incorporates a means for rotating the position of the means for indicating level or plumb embedded in both arms to an alternate, 90° position. This allows use of the means for indicating level or plumb to be adjusted to indicate either condition in any alternate 90° orientation.

The thicknesses edge of the tool may be made in a dimension equal to the thickness of the drywall or wallboard to be installed. The thickness of the edge may also be greater than the thickness of the drywall or wallboard to be installed, up to a dimension equal to that of the thickest commercially available drywall or wallboard. In this mode, a system of markings indicating the thickness of various thinner sizes of drywall or wallboard can be employed. The various sheet rock thicknesses may be indicated by inscription of lines equal to the thickness of various sizes of sheet rock, parallel to the horizontal edges of the face of the gauge when the gauge is laid flat. Alternatively, the various thicknesses may be indicated by lines printed in the edge of the gauge or employing color coded bands to indicate the relative thicknesses.

Other embodiments are within the following claims.

Although the present invention has been described with reference to preferred embodiments, workers skilled in the art will recognize that changes can be made in form and detail without departing from the spirit and scope of the present invention.

What is claimed is:

1. A hand-held level and plumb tool comprising:

a homogenous, L-shaped body including first and second legs arranged relative to one another to define a 90° angle;

wherein the first and second legs each define:

an interior side, an exterior side, a central panel extending between the sides, a length in extension from the opposing leg to a free end, a slot formed through a thickness of the central panel and extending along at least a majority of the length;

wherein the slot of the first leg is open to the slot of the second leg at a corner intersection defined by the legs;

a first level indicating device assembled to the central panel of the first leg at a location spaced from the corresponding slot; and a second level indicating device assembled to the second leg.

2. The tool of claim 1, wherein the L-shaped body further forms a notch at an intersection of the interior side of the first leg and the interior side of the second leg.

3. The tool of claim 1, wherein the slot of the first leg terminates at a slot end adjacent the free end of the first leg, and further wherein the first level indicating device is positioned between the slot end and the free end of the first leg.

4. The tool of claim 1, wherein the second level indicating device is assembled to the central panel of the second leg at a location spaced from the slot of the second leg.

5. The tool of claim 4, wherein the second level indicating device is located between the slot and the interior side of the second leg.

6. The tool of claim 5, wherein the first level indicating device is located between the slot and the free end of the first leg.

7. The tool of claim 6, wherein the length of the first leg is greater than the length of the second leg.

8. The tool of claim 1, wherein each of the slots has a width sized to receive a writing implement.

9. The tool of claim 1, wherein the first leg further includes a frame having an interior portion defining the interior side and an exterior portion defining the exterior side, and further wherein a thickness of the frame is greater than a thickness of the first leg central panel.

10. The tool of claim 9, wherein the central panel of the first leg is centrally positioned relative to the thickness of the frame.

11. The tool of claim 9, wherein the second leg further includes a central panel and a frame having an interior portion and an exterior portion, the frame of the second leg having a thickness greater than a thickness of the central panel of the second leg.

12. The tool of claim 11, wherein the exterior portion of the first leg intersects the exterior portion of the second leg to form a contiguous exterior edge of the L-shaped body.

13. The tool of claim 9, wherein the first leg further includes first measurement indicia formed on a face of the central panel adjacent the exterior frame portion and secondary measurement indicia formed on a face of the exterior frame portion.

14. The tool of claim 13, wherein each of the measurement indicias include markings corresponding with distances along the exterior side from a corner defined by the first and second legs toward the corresponding free end, and further wherein a number of the markings of the first measurement indicia is greater than a number of the markings of the secondary measurement indicia.

15. The tool of claim 14, wherein the first measurement indicia includes markings corresponding with distances in the range of at least 1-9 inches, and the secondary measurement indicia is limited to markings corresponding with distances in the range of not less than 6 inches and not more than 8 inches.

16. The tool of claim 15, wherein the second leg includes first measurement indicia on a face of the corresponding central panel, and secondary measurement indicia along the corresponding exterior side in a plane parallel with the face of the central panel of the second leg, and further wherein the first measurement indicia of the second leg includes markings corresponding with distances in the range of at least 1-12 inches, and the secondary measurement indicia of the second leg includes markings limited to distances in the range of not less than 8 inches and not more than 11 inches.

17. A hand-held level and plumb tool comprising:

a homogenous, L-shaped body including first and second legs arranged relative to one another to define a 90° angle;

wherein the first and second legs each include:

a frame having an interior portion defining an interior side, and an exterior portion defining an exterior side, a central panel extending between the interior and exterior portions, wherein a thickness of the frame is greater than a thickness of the central panel, a length in extension from the opposing leg to a free end, a slot formed through a thickness of the central panel and extending along at least a majority of the length;

a first level indicating device assembled to the central panel of the first leg at a location spaced from the corresponding slot; and a second level indicating device assembled to the second leg.

18. The tool of claim 17, wherein the slot of the first leg is open to the slot of the second leg at a corner intersection defined by the legs.

* * * * *